United States Patent [19]

Laskaris

[11] Patent Number: 4,526,015

[45] Date of Patent: Jul. 2, 1985

[54] SUPPORT FOR CRYOSTAT PENETRATION TUBE

[75] Inventor: Evangelos T. Laskaris, Schenectady, N.Y.

[73] Assignee: General Electric Company, Schenectady, N.Y.

[21] Appl. No.: 661,013

[22] Filed: Oct. 15, 1984

[51] Int. Cl.[3] ..... F25B 19/00

[52] U.S. Cl. ..... 62/514 R; 62/297; 220/85 S; 285/47; 285/DIG. 5

[58] Field of Search ..... 62/514 R, 45, 295, 297; 220/85 S; 285/47, DIG. 5

[56] References Cited

U.S. PATENT DOCUMENTS

| | | | |
|---|---|---|---|
| 3,066,222 | 11/1962 | Poorman et al. | 62/514 R |
| 3,261,180 | 7/1966 | Porter et al. | 62/514 R |
| 3,423,955 | 1/1969 | Wright | 62/514 R |
| 3,483,709 | 12/1969 | Baicker et al. | 62/514 R |
| 4,228,662 | 10/1980 | Klipping | 62/514 R |

*Primary Examiner*—Ronald C. Capossela

*Attorney, Agent, or Firm*—Lawrence D. Cutter; James C. Davis, Jr.; Marvin Snyder

[57] ABSTRACT

Penetration tubes extending between inner and outer walls of a cryostat necessarily comprise thin walled structures to minimize thermal conduction. However, in cryostat structures in which the inner vessel is capable of undergoing the relative motion with respect to the outer vessel, particularly during transport and thermal contraction, a means of accommodating this motion must be found which does not impose significant stresses on the thin walled penetration tube. Accordingly, the present invention provides a bearing and bellows arrangement which accommodates axial motion, thermal expansion and contraction and rocking motions of the inner cryostat, while at the same time ensuring the maintenance of vacuum conditions between the cryostat walls.

12 Claims, 1 Drawing Figure

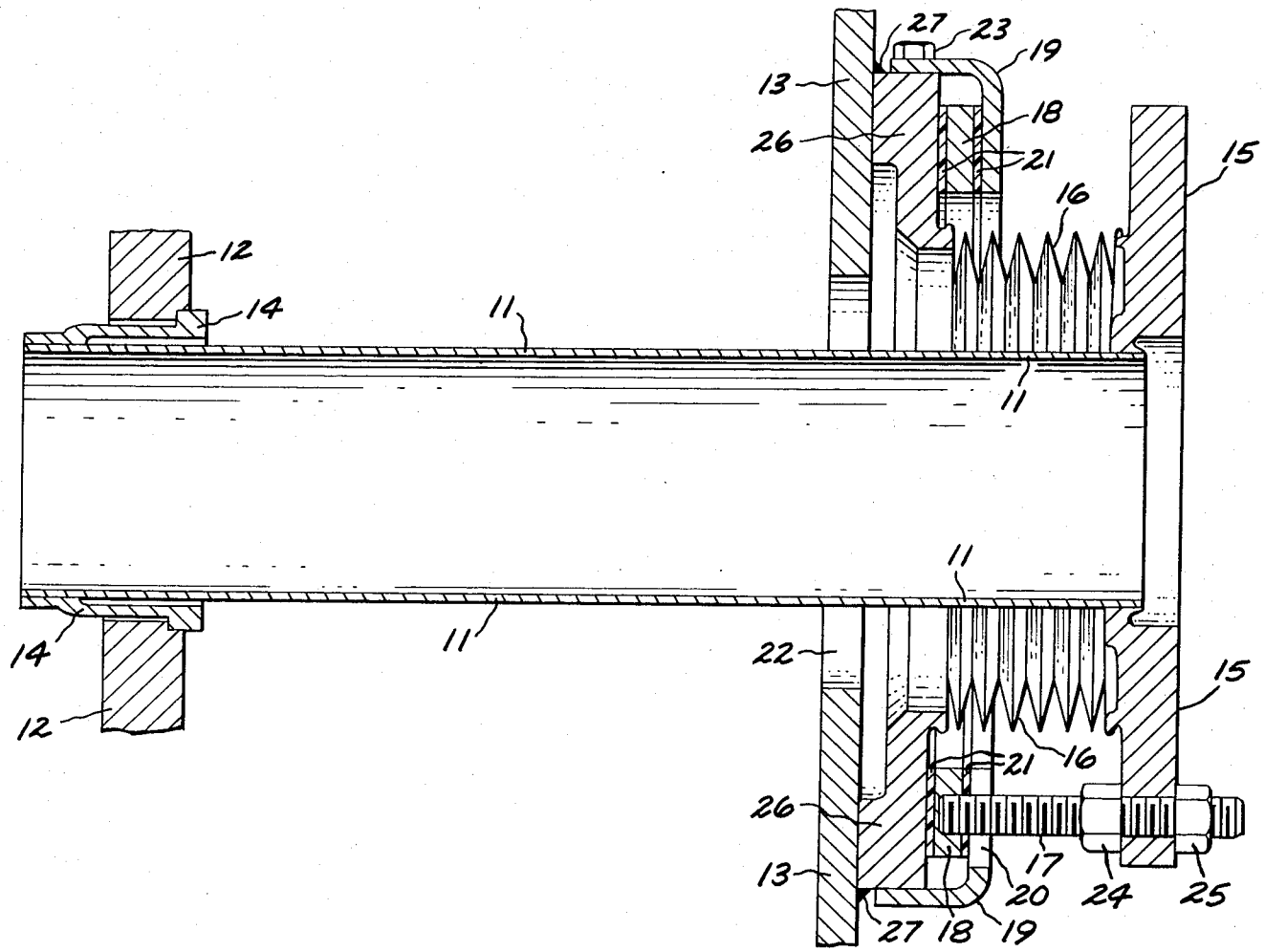
15
15
25
24
16
16
17
20
19
18
21
21
19
23
27
18
27
11
11
13
26
22
26
13
11
11
12
14
14
12

SUPPORT FOR CRYOSTAT PENETRATION TUBE

BACKGROUND OF THE INVENTION

The present invention is related to cryostat construction and in particular to means for supporting a thin-walled horizontal penetration tube so as to permit relative motion between inner and outer cryostat vessels without unduly stressing the penetration tube. The present invention is also related to the construction of cryostats for containing coolants such as liquid helium used to cool the superconductive windings of a main magnet for a medical diagnostic nuclear magnetic resonance (NMR) imaging system.

Conventional cryostats for NMR imaging systems typically require disruption of the cryostat vacuum for the purpose of inserting temporary stiffening supports to protect the magnet and internal components during transportation. Transportation of such superconducting magnets is therefore seen to require re-establishment of internal vacuum conditions after the magnet is disassembled to remove the temporary support. This is a time-consuming operation. In conventional cryostat designs, large elastomer seals are commonly employed to facilitate assembly and disassembly. Furthermore, other cryostat designs have included a non-metallic cryostat bore tube wall to prevent eddy current field distortions when NMR gradient coils are energized. These gradient coils are typically disposed within the bore of the magnet assembly. However, both elastomer seals and non-metallic bore tubes are permeable to gases and either design results in contamination of the internal vacuum conditions during long term operation of the device. Therefore, periodic pumping of the cryostat is required. Moreover, seal replacement requires periodic total shutdown and warming of the superconductor windings to ambient temperature conditions. Accordingly, it is seen that it is desirable to permanently maintain vacuum conditions within a cryostat, not only for purposes of transport, but also for purposes of long term operation.

Conventional cryostat designs also typically employ an access port for addition of coolants such as liquid helium in awkward positions on top of the cylindrical cryostat structure. Such coolant access means are conventionally disposed on the curved side surface of the cryostat and adds significantly to the overall dimensions of the cryostat assembly. This is a significant disadvantage for cryostats employed to house superconducting windings which are used to produce a high intensity magnetic field for whole body NMR imaging application. Since the bore tube of the magnet assembly must be sized to accommodate the human form, with the bore tube typically being approximately one meter in diameter, the overall size of the magnet and cryostat significantly affects the cost, most notably of the magnet itself but also the cost of the room or structure in which it is housed. Accordingly, it is desired to provide a cryostat housing having horizontal access means for addition of liquid coolant and for penetration of electrical leads, these means being located at the end surface of the cryostat.

In order to minimize thermal conduction between inner and outer cryostat vessel walls, a thin walled penetration tube is employed. Additionally, vacuum conditions are maintained between inner and outer cryostat vessels and a system of supporting ties is employed at each end of the inner vessel so as to support the inner vessel within the outer vessel. It is also noted that in these cryostat structures, intermediate vessels and thermal radiation shields are also typically present to increase the effectiveness of the cryostat. However, a system of supporting ties preferably permits axial motion so that the inner vessel may be moved axially and locked into a fixed position during transport. This permits transport of the magnet and cryostat assembly in a fully charged condition, that is, in a condition in which the magnet and coil superconductors have already been cooled to below their critical temperatures. This permits rapid system installation.

However, relative motion of the inner and outer cryostat vessels can severely stress the thin walled penetration tube. Accordingly, one of the objects of the present invention is to provide a support for this relatively delicate penetration tube. In addition to axial motion which is deliberately employed for purposes of transport to lock the inner cryostat vessel in a fixed position, transverse and rocking motions of the inner vessel can also occur. Thin walled penetration tubes fixed to both the inner and outer cryostat vessels could be subject to potentially damaging mechanical stresses as a result of the relative motion between the inner and outer cryostat vessels. Additionally, differential thermal expansion and contraction effects can also operate to induce stress in penetration tubes which are firmly anchored to both the inner and outer vessel walls. The large transverse displacements and rocking motions of the inner vessel during shipment could subject the thin walled penetration tube to high bending stresses beyond yield strength. Additionally, this tube must also withstand axial loads as a result of the cryostat vacuum and magnetic interactions with external ferromagnetic objects.

SUMMARY OF THE INVENTION

In accordance with a preferred embodiment of the present invention, a penetration assembly for a cryostat comprises a penetration tube affixed to an inner cryostat wall and extending through an aperture in an outer cryostat wall; an outer flange is affixed to the exterior end of the penetration tube and an airtight bellows is affixed to and extends from the outer flange toward the outer wall so as to surround the aperture in the outer wall; additionally, a washer-shaped bearing together with means to hold the bearing in a plane substantially parallel to the outermost wall is provided. The bearing is affixed to the outer flange, such as by threaded bolts disposed through radially oriented slots in the bearing hold down means. The bearing is preferably provided with a coated surface so as to be able to readily permit transverse motions. The penetration assembly is therefore seen to provide axial motion through the bellows, when desired. Transverse motions and rocking motions are seen to be accommodated by the combination of the bellows and the bearing assembly which functions essentially as a thrust bearing.

Accordingly, it is an object of the present invention to provide support means for a thin walled cryostat penetration tube.

It is an additional object of the present invention to provide a penetration support structure which preserves internal vacuum conditions.

It is also an object of the present invention to provide a penetration tube between inner and outer cryostat vessels which exhibits low levels of thermal conductivity.

Lastly, but not limited hereto, it is an object of the present invention to prevent high bending stresses from occurring in cryostat penetration tubes.

DESCRIPTION OF THE FIGURE

The subject matter which is regarded as the invention is particularly pointed out and distinctly claimed in the concluding portion of the specification. The invention, however, both as to organization and method of practice, together with further objects and advantages thereof may best be understood by reference of the following description taken in connection with the accompanying drawing in which:

The FIGURE is a cross-sectional side elevation view of a cryostat penetration assembly in accordance with the present invention particularly illustrating a penetration tube extending between an inner and an outer cryostat vessel wall.

DETAILED DESCRIPTION OF THE INVENTION

The FIGURE illustrates, in cross-section, cryostat penetration tube 11 extending between inner cryostat vessel wall 12 and outer cryostat vessel wall 13. Throughout the FIGURE all structures shown are metallic except for coating 21 on bearing 18. In particular, the metallic structures preferably comprise non-magnetic alloys such as aluminum or stainless steel. In particular, penetration tube 11 preferably comprises stainless steel.

At the inner or cold end of penetration tube 11, it is joined to inner cryostat vessel wall 12 by means of transition collar 14 which preferably comprises aluminum. Collar 14 is brazed to tube 11 at one end and welded to inner vessel wall 12 as shown. Penetration tube 11 extends through aperture 22 in exterior cryostat vessel wall 13. Penetration tube 11 is welded to outer or exterior flange 15, which also preferably comprises stainless steel. Metal bellows 16 is sealably affixed to outer flange 15 so as to surround penetration tube 11 and so as to extend toward outer vessel wall 13 to which it is either directly or indirectly sealably affixed so as to surround aperture 22. Bellows 16 provides sufficient flexibility to accommodate large transverse displacements. Bellows 16 may be directly affixed to exterior wall 13, but may also be affixed to circular boss 26 which is itself affixed to exterior wall 13 by means of weld joint 27. In particular, inner vessel wall 12, collar 14, penetration tube 11, flange 15, bellows 16, boss 26 and exterior vessel wall 13 all form part of an evacuable volume maintained between the inner and outer cryostat vessels.

Bolts 17 (one shown) are affixed to flange 15 by any convenient means such as by nuts 24 and 25, as shown. One end of bolt 17 is affixed to flange 15 with the other end being affixed to split ring bearing 18 disposed between boss 26 and cup shaped retaining flange 19 which is affixed to boss 26 by any convenient means, such as by bolt 23 as shown. Bearing 18 is provided with a slippery coating such as polytetrafluoroethylene (PTFE). For this purpose, materials such as Teflon TM and Rulon TM may be employed. Bolts 17 are threaded directly into bearing 18. It is also seen that boss 26 together with retaining flange 19 provide a channel in which bearing 18 may undergo transverse motions which are substantially parallel to the plane of outer vessel wall 13. Coating 21 on bearing 18 facilitates this motion and prevents binding which would induce stress in thin walled tube 11. Additionally, it is seen that bolts 17 are disposed through radially oriented slots 20 in retaining flange 19. Bearing 18 is restrained axially by retaining flange 19, but is free to move transversely so as to function as a thrust bearing. Axial clearance is provided between bearing 18 and its housing so that small rocking motions of penetration tube 11 are accommodated.

From the above, it should be appreciated that the penetration tube assembly of the present invention permits tube motions which are desired to prevent excessive stress in the thin walled structure. It is also seen that bellows 16 permits the desired axial positioning of the inner and outer vessels and also simultaneously, in cooperation with coated thrust bearing 18, permits the desired degree of transverse and rocking motions which are particularly associated with cryostat transport. Additionally, it is seen that the penetration tube assembly of the present invention also provides means for compensating differing degrees and rates of thermal expansion between the inner and outer cryostat vessels, particularly during cryostat coolant charging operations.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A penetration assembly for a cryostat having an inner wall and an outer wall, said assembly comprising:

a penetration tube affixed to said inner wall and extending through an aperture in said outer wall;

an outer flange affixed to the exterior end of said penetration tube;

an air tight bellows affixed to and extending from said outer flange toward said outer wall, said bellows also being affixed relative to said outer cryostat wall so as to surround said aperture;

a washer-shaped bearing through which said penetration tube is disposed, said bearing being disposed between said outer wall and said flange;

means to hold said bearing so as to restrict its permissible motions to those lying in a plane substantially parallel to said outer wall; and means to affix said outer flange to said bearing.

2. The assembly of claim 1 in which said bearing includes bearing surfaces coated with a lubricative material.

3. The assembly of claim 2 in which said lubricative material comprises polytetrafluoroethylene.

4. The assembly of claim 1 in which said holding means comprises a cupped shaped retaining flange affixed to said outer wall.

5. The assembly of claim 4 in which said retaining flange is affixed to a circular boss which is affixed to said outer wall.

6. The assembly of claim 5 in which said bellows is affixed to said boss.

7. The assembly of claim 4 in which said retaining flange comprises material selected from the group consisting of stainless steel and aluminum.

8. The assembly of claim 1 in which said penetration tube comprises material selected from the group consisting of stainless steel and aluminum.

9. The assembly of claim 1 in which said outer flange comprises material selected from the group consisting of stainless steel and aluminum.

10. The assembly of claim 1 in which said bearing comprises material selected from the group consisting of stainless steel and aluminum.

11. The assembly of claim 1 in which said boss comprises materials selected from the group consisting of stainless steel and aluminum.

12. The assembly of claim 1 in which said penetration tube is affixed to said inner vessel wall by means of a collar.

* * * * *